US011802728B2

(12) United States Patent
Jung et al.

(10) Patent No.: US 11,802,728 B2
(45) **Date of Patent: *Oct. 31, 2023**

(54) REFRIGERATOR

(71) Applicant: LG Electronics Inc., Seoul (KR)

(72) Inventors: Wonyeong Jung, Seoul (KR); Deokhyun Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/702,564

(22) Filed: Mar. 23, 2022

(65) Prior Publication Data

US 2022/0214098 A1 Jul. 7, 2022

Related U.S. Application Data

(63) Continuation of application No. 16/675,716, filed on Nov. 6, 2019, now Pat. No. 11,313,613, which is a (Continued)

(30) Foreign Application Priority Data

Nov. 2, 2011 (KR) ..... 10-2011-0113415

(51) Int. Cl.
*F25D 23/06* (2006.01)

(52) U.S. Cl.
CPC ..... *F25D 23/061* (2013.01); *F25D 23/062* (2013.01); *F25D 23/065* (2013.01); (Continued)

(58) Field of Classification Search
CPC .... F25D 23/067; F25D 23/061; F25D 23/065; F25D 23/06
(Continued)

(56) References Cited

U.S. PATENT DOCUMENTS 1,518,668 A 12/1924 Mitchell
1,541,945 A 6/1925 Hamilton
(Continued)

FOREIGN PATENT DOCUMENTS

CN 85106738 6/1986
CN 2033487 3/1989
(Continued)

OTHER PUBLICATIONS

Chinese Office Action dated Aug. 1, 2014 for Chinese Application. No. 201210433194.5, with English Translation, 17 pages.
(Continued)

*Primary Examiner* — John K Fristoe, Jr.
*Assistant Examiner* — Jennifer Castriotta
(74) *Attorney, Agent, or Firm* — Fish & Richardson P.C.

(57) ABSTRACT

A refrigerator including an inner case, an outer case, and a vacuum space provided between the inner case and the outer case to insulate the inner case from the outer case. The inner case defines an exterior appearance of a storage space, with a communication hole formed therein. The outer case is spaced apart a predetermined distance from the inner case, and a communication is formed at a position corresponding to the communication hole of the inner case. A connection pipe passes through the vacuum space to connect the communication hole of the inner case and the communication hole of the outer case with each other.

29 Claims, 7 Drawing Sheets

Related U.S. Application Data continuation of application No. 16/137,290, filed on Sep. 20, 2018, now Pat. No. 10,514,197, which is a continuation of application No. 14/958,328, filed on Dec. 3, 2015, now Pat. No. 10,082,328, which is a continuation of application No. 13/654,566, filed on Oct. 18, 2012, now Pat. No. 9,228,775.

(52) U.S. Cl.
CPC ..... *F25D 23/067* (2013.01); *F25D 2201/10* (2013.01); *F25D 2201/14* (2013.01)

(58) Field of Classification Search
USPC ... 220/592.01–592.26, 652, 651, 639, 694.4, 220/565, 567.1–567.3; 138/121, 118, 122
See application file for complete search history.

(56) References Cited

U.S. PATENT DOCUMENTS

| | | | |
|---|---|---|---|
| 1,561,769 | A | 11/1925 | Ballew |
| 1,588,707 | A | 6/1926 | Alexander |
| 1,747,969 | A | 2/1930 | Carrey |
| 1,770,200 | A | 7/1930 | Comstock |
| 1,814,114 | A | 7/1931 | Light |
| 1,833,633 | A | 11/1931 | Light |
| 2,000,882 | A | 5/1935 | Comstock |
| 2,044,600 | A | 6/1936 | Willaims |
| 2,053,252 | A | 9/1936 | Cook et al. |
| 2,102,698 | A | 12/1937 | Gould |
| 2,196,373 | A | 4/1940 | Wallach |
| 2,773,362 | A | 12/1956 | Scheitlin |
| 3,161,265 | A | 12/1964 | Matsch |
| 4,036,617 | A | 7/1977 | Leonard et al. |
| 4,147,037 | A | 4/1979 | Gelbard et al. |
| 4,301,658 | A | 11/1981 | Reed |
| 4,526,015 | A | 7/1985 | Laskaris |
| 4,959,111 | A | 9/1990 | Kruck |
| 5,027,574 | A | 7/1991 | Phillip |
| 5,081,761 | A | 1/1992 | Rinehart et al. |
| 5,157,893 | A | 10/1992 | Benson et al. |
| 5,175,975 | A | 1/1993 | Benson et al. |
| 6,037,033 | A | 3/2000 | Hunter |
| 6,073,944 | A | 6/2000 | Moore |
| 6,224,179 | B1 | 5/2001 | Wenning et al. |
| 6,257,684 | B1 | 7/2001 | Hirath et al. |
| 6,393,798 | B1 | 5/2002 | Hirath et al. |
| 6,479,112 | B1 | 11/2002 | Shukuri et al. |
| 6,938,968 | B2 | 9/2005 | Tanimoto et al. |
| 7,003,973 | B2 | 2/2006 | Lee et al. |
| 7,806,955 | B2 | 10/2010 | Wang et al. |
| 2001/0055478 | A1 | 12/2001 | Scherzer et al. |
| 2003/0167789 | A1 | 9/2003 | Tanimoto et al. |
| 2005/0175809 | A1 | 8/2005 | Hirai et al. |
| 2005/0200252 | A1 | 9/2005 | Muller et al. |
| 2007/0214824 | A1 | 9/2007 | Itsuki |
| 2010/0251653 | A1 | 10/2010 | Mills |
| 2011/0259040 | A1 | 10/2011 | Cataldo et al. |
| 2012/0060543 | A1 | 3/2012 | Hanley et al. |
| 2012/0104002 | A1 | 5/2012 | Jung et al. |
| 2013/0029082 | A1 | 1/2013 | Park |

FOREIGN PATENT DOCUMENTS

| | | |
|---|---|---|
| CN | 2226260 | 5/1996 |
| CN | 2241851 | 12/1996 |
| CN | 1536305 | 10/2004 |
| CN | 2720362 | 8/2005 |
| CN | 2777463 | 5/2006 |
| CN | 101038121 | 9/2007 |
| CN | 101487652 | 7/2009 |
| CN | 101595340 | 12/2009 |
| CN | 101793455 | 8/2010 |
| EP | 0071090 | 2/1983 |
| EP | 1835242 | 9/2007 |
| JP | S60137293 | 9/1985 |
| JP | 200516629 | 1/2005 |
| JP | 2003156193 | 4/2005 |
| JP | 2005163848 | 6/2005 |
| JP | 2009174797 | 8/2009 |
| KR | 1020050028296 | 3/2005 |
| KR | 100725188 | 4/2007 |
| KR | 1020090059660 | 6/2009 |
| KR | 1020110072686 | 6/2011 |
| WO | WO1999020961 | 4/1999 |
| WO | WO2011016693 | 2/2011 |

OTHER PUBLICATIONS

Chinese Office Action dated Jul. 24, 2014 for Chinese Application No. 201210432112.5, with English Translation, 21 pages.
Chinese Office Action dated Jul. 7, 2014 for Chinese Application No. 201210428777.9, with English Translation, 26 pages.
European Search Report in European Application No. 12007264.0, dated Sep. 14, 2018, 5 pages.
Partial European Search Report in European Application No. 12007264.0, dated Apr. 20, 2017, 12 pages (with English translation).
U.S. Final Office Action dated Aug. 31, 2015, for U.S. Appl. No. 13/655,677, 37 pages.
U.S. Office Action dated Dec. 15, 2014 for U.S. Appl. No. 13/654,551, 11 Pages.
U.S. Office Action dated Jun. 27, 2014 for U.S. Appl. No. 13/665,057, 14 pages.
U.S. Office Action dated Mar. 5, 2015 for U.S. Appl. No. 13/655,677, 18 pages.
Korean Notice of Allowance in Korean Application No. 10-2011-0113415, dated Feb. 14, 2018, 3 pages.
Korean Notice of Allowance in Korean Application No. 10-2019-0028115, dated Mar. 21, 2019, 8 pages (with English [SJ translation).

REFRIGERATOR

CROSS-REFERENCE TO RELATED APPLICATIONS

This application is a continuation of U.S. application Ser. No. 16/675,716, filed on Nov. 6, 2019, which is a continuation of U.S. application Ser. No. 16/137,290, filed Sep. 20, 2018, now U.S. Pat. No. 10,514,197, which is a continuation of U.S. application Ser. No. 14/958,328, filed Dec. 3, 2015, now U.S. Pat. No. 10,082,328, which is a continuation of U.S. application Ser. No. 13/654,566, filed Oct. 18, 2012, now U.S. Pat. No. 9,228,775, which claims priority under 35 U.S.C. § 119 from Korean Application No. 10-2011-0113415, filed Nov. 2, 2011, the contents of which are incorporated herein by reference.

BACKGROUND

1. Field

Embodiments of the invention relate to a refrigerator, more particularly, to a refrigerator including a vacuum space formed between an outer case and an inner case to improve an insulation function thereof.

2. Background

A refrigerator is an electric home appliance can keep food stored in a storage compartment at a low temperature or a temperature below zero, using a refrigerant cycle.

A conventional configuration of such a refrigerator is provided with a case where a storage space is defined to store foods and a door rotatably or slidingly coupled to the case to open and close the storage space.

The case includes an inner case where the storage space is formed and an outer case configured to accommodate the inner case. An insulating material is arranged between the inner case and the outer case.

Such an insulating material suppresses the outdoor temperature from affecting an internal temperature of the storage space.

An example of the insulation material is urethane foams. Such urethane foams can be injection-foamed in the space formed between the inner and outer cases.

In this instance, to realize an insulation effect by using such the insulating material, a predetermined thickness of the insulating material has to be secured and that means that the insulating material becomes thick. Accordingly, a wall between the inner and outer cases becomes thick and the size of the refrigerator is increased as much as the thickness.

However, as a recent trend of a compact-sized refrigerator is one the rise, there is the need for the structure of the refrigerator that can make the volume of the internal storage space larger and the external size smaller.

Accordingly, the present invention proposes a refrigerator having a new structure which can perform insulation by forming a vacuum space, not by injecting the insulating material between the inner case and the outer case.

Meanwhile, vapors might be cooled and changed into frost in an evaporator composing a freezing cycle provided in the refrigerator. Such frost might be stuck to a surface of the evaporator. To solve such a problem of frost, a defrosting apparatus may be provided in the refrigerator to remove the frost by heating the frost to change it into water.

The water melted by the defrosting apparatus is exhausted to the outside of the refrigerator via a drainage pipe and such a drainage pipe is connected to the outside passing through the inner case, the outer case and the insulating material provided between the inner and outer cases.

Rather than such the drainage pipe, another pipe may be connected to the outside from the inside of the refrigerator.

In the conventional refrigerator having a foaming agent provided in the space between the inner case and the outer case, the pipe is simply connected to pass through the inner case, the insulating material and the outer case.

Accordingly, the pipe is molded of plastic and the plastic-molded pipe is disposed to pass the inner case and the outer case, and then the insulating material is foaming.

However, in the vacuum refrigerator according to the present invention, the pipe is connected to pass the vacuum space, with maintaining the airtight state of the vacuum space. If the plastic pipe is used, it is difficult to maintain the airtight state at the connection area between the pipe and the vacuum space and the connection area cannot endure the vacuum pressure of the vacuum space disadvantageously.

Moreover, if the pipe is formed of a metal pipe capable of being welded to the inner case and the outer case formed of a steel sheet, heat transfer might be generated via the pipe and an insulation performance of the refrigerator might be deteriorated accordingly.

SUMMARY

To solve the problems, an object of the invention is to provide a refrigerator that is able to improve an insulation effect by forming the vacuum space between the inner case and the outer case and to promote a compact volume.

Another object of the present invention is to provide a refrigerator that is able to form the vacuum space between the inner case and the outer case and that has a supporting structure to maintain the distance between the inner case and the outer case, without deformation of the inner and outer cases generated by an external shock.

A further object of the present invention is to provide a refrigerator including a connection pipe that has a structure capable of enduring a vacuum pressure, with allowing a drainage pipe, a pipe or a refrigerant pipe to pass through the vacuum space.

A still further object of the present invention is to provide a refrigerator having a connection pipe that can reduce the heat transfer generated there through.

To achieve these objects and other advantages and in accordance with the purpose of the embodiments, as embodied and broadly described herein, a refrigerator comprise an inner case that defines a storage space and that has a first communication hole defined through the inner case; an outer case that is spaced apart a distance from the inner case and that has a second communication hole defined through the outer case at a position corresponding to the first communication hole of the inner case, the outer case and the inner case defining, between the outer case and the inner case, a vacuum space that is maintained at a partial vacuum pressure and that is configured to insulate the inner case from the outer case; and a connection pipe that passes through the vacuum space and that connects the first communication hole of the inner case to the second communication hole of the outer case.

The connection pipe may connect a space defined by the inner case with a space defined by the outer case.

An internal space of the connection pipe may be in a state other than a vacuum state.

The connection pipe may define a passage through which water is drained or through which a drainage pipe passes.

The connection pipe may comprise a lateral wall corrugation part that defines a lateral wall of the connection pipe in a corrugated manner.

The lateral wall corrugation part may be configured to decrease conduction efficiency by increasing a distance where conduction between the inner case and the outer case is generated.

The lateral wall corrugation part of the connection pipe may comprise a metal thin film having a thickness of 0.05-0.2 mm.

The connection pipe may be welded to the inner case and the outer case.

The refrigerator may further comprise a first support plate located at a surface of the inner case that faces the outer case; and a plurality of spacers configured to maintain the vacuum space between the inner case and the outer case.

The refrigerator may further comprise a second support plate located at a surface of the outer case that faces the first support plate.

The plurality of spacers may be fixed to the first support plate and the second support plate comprises a plurality of grooves that are defined in an inner surface thereof and that are configured to receive ends of the spacers therein.

The connection pipe may be welded to the inner case and the outer case, and passes through the first support plate and the second support plate.

A third communication hole may be defined through the first support plate and a fourth communication hole is defined through the second support plate, the third communication hole and the fourth communication hole correspond to the first communication hole defined through the inner case and the second communication hole defined through the outer case, and the third communication hole defined through the first support plate and the fourth communication hole defined through the second support plate are larger than the first communication hole defined through the inner case and the second communication hole defined through the outer case.

The connection pipe may be spaced apart a distance from the plurality of spacers such that the connection pipe does not interfere with the plurality of spacers.

Plastic may be coated on an inner surface of the connection pipe to reduce corrosion.

In another aspect of the present invention, a refrigerator comprises an inner case that defines a storage space and that has a first communication hole defined through the inner case; an outer case that is spaced apart a distance from the inner case and that has a second communication hole defined through the outer case at a position corresponding to the first communication hole of the inner case, the outer case and the inner case defining, between the outer case and the inner case, a vacuum space that is maintained at a partial vacuum pressure and that is configured to insulate the inner case from the outer case; and a communication pipe that connects a space defined by the inner case with a space defined by the outer case.

The refrigerator may further comprise a first support plate located at a surface of the inner case that faces the outer case; and a plurality of spacers configured to maintain the vacuum space between the inner case and the outer case.

In further aspect of the present invention, a refrigerator comprises an inner case that defines a storage space and that has a first communication hole defined through the inner case; an outer case that is spaced apart a distance from the inner case and that has a second communication hole defined through the outer case at a position corresponding to the first communication hole of the inner case, the outer case and the inner case defining, between the outer case and the inner case, a vacuum space that is maintained at a partial vacuum pressure and that is configured to insulate the inner case from the outer case; and a connection pipe that passes through the vacuum space and that connects the first communication hole of the inner case to the second communication hole of the outer case, wherein at least a portion of a lateral wall of the connection pipe has a bellow pipe type configuration.

The connection pipe may connect a space defined by the inner case with a space defined by the outer case.

The connection pipe may define a passage through which water is drained or through which a drainage pipe passes.

The refrigerator according to embodiments has following advantageous effects. According to the refrigerator, the vacuum space is formed between the inner case and the outer case, instead of the conventional insulating material. Such the vacuum space performs the insulation to restrain heat transfer between the inner case and the outer case.

The insulation effect of the vacuum state is more excellent than the conventional insulating material. The refrigerator according to the present invention has an advantage of excellent insulation, compared with the insulation effect achieved by the conventional insulating material the conventional refrigerator. The refrigerator according to the present invention has an advantage of good insulation, compared with the conventional refrigerator.

Meanwhile, if the vacuum state of the vacuum space is maintained, the insulation function is performed, regardless of the thickness (the distance between the inner case and the outer case). However, the thickness of the conventional insulating material has to be larger to enhance the insulating effect and such increase of the thickness results in increase of the refrigerator size.

Accordingly, compared with the conventional refrigerator, the refrigerator according to the present invention can reduce the size of the outer case while maintaining the storage compartment with the same size. Accordingly, the present invention can be contributed to a compact sized refrigerator.

Furthermore, the present invention can provide a refrigerator including a connection pipe that has a structure capable of enduring a vacuum pressure, with allowing a drainage pipe, a pipe or a refrigerant pipe to pass through the vacuum space.

Still further, the connection pipe passing through the vacuum space formed between the inner case and the outer case can reduce heat transfer.

Still further, a predetermined portion of a lateral wall possessed by the connection pipe is formed of a bellows type pipe that can be elastically transformed. Accordingly, durability of the refrigerator may be enhanced with respect to an external shock.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary embodiments of the present invention will be described in detail, referring to the accompanying drawing figures which form a part hereof.

Figure 1:
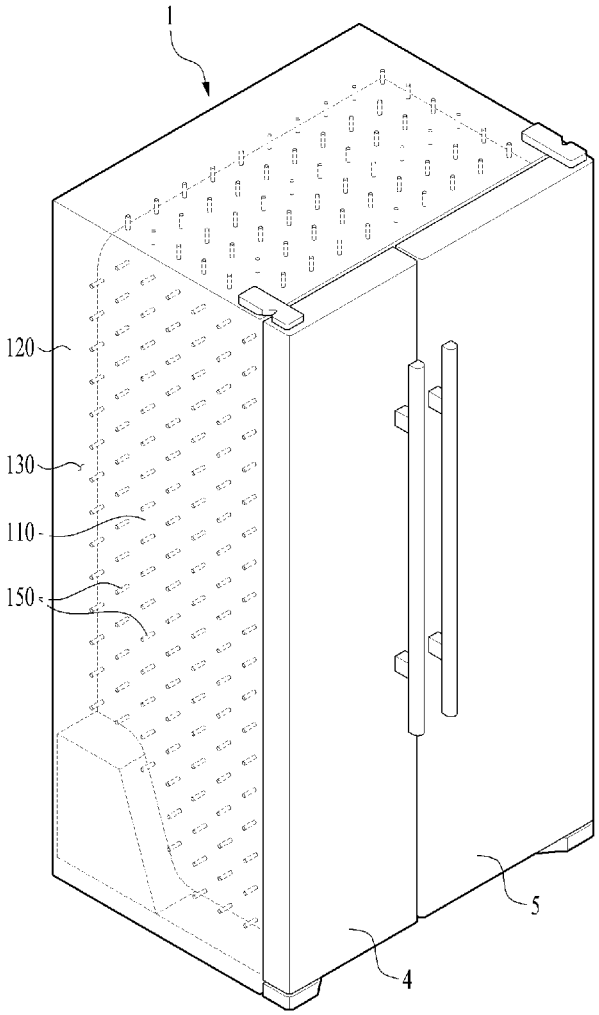
FIG. 1 is a perspective view of a refrigerator according to one embodiment of the present invention.
Figure 2:
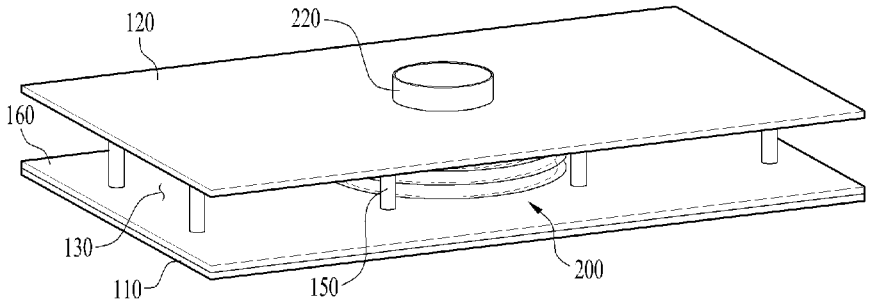
FIG. 2 is a partially cut-away perspective view illustrating a connection pipe passing through a vacuum space formed between an inner case and an outer case in the refrigerator according to the present invention.
Figure 3:
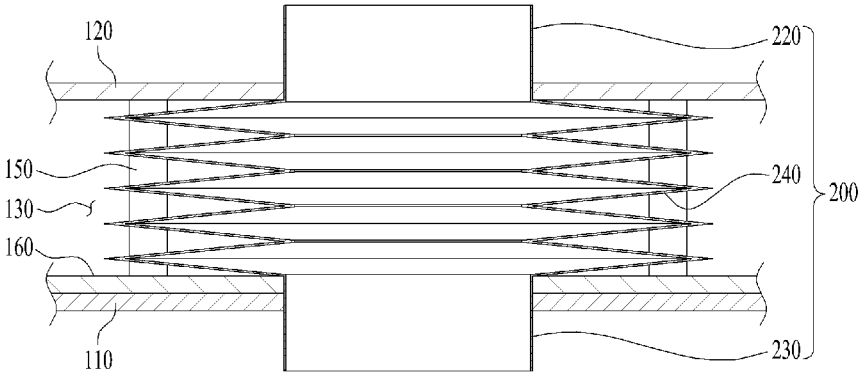
FIG. 3 is a partial sectional view illustrating the connection pipe of FIG. 2 and the inner and outer cases adjacent to the connection pipe.
Figure 4:
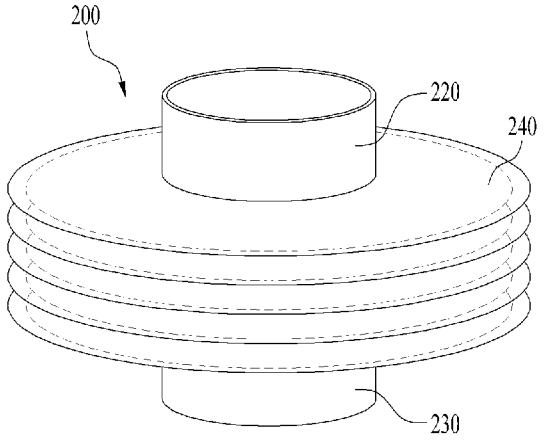
FIG. 4 is a perspective view separately illustrating the connection pipe of FIG. 3.

FIG. 1 illustrates a refrigerator according to one embodiment of the present invention. FIG. 2 is a partially cut-away perspective view illustrating a connection pipe passing through a vacuum space formed between an inner case and an outer case in the refrigerator according to the present invention. FIG. 3 is a partial sectional view illustrating the connection pipe of FIG. 2 and the inner and outer cases adjacent to the connection pipe. FIG. 4 is a perspective view separately illustrating the connection pipe of FIG. 3.

As shown in FIG. 1, the refrigerator according to one embodiment of the present invention includes a case 1 in which a storage chamber is formed, a first door 4 rotatably coupled to a left side of the case 1 and a second door 5 rotatably coupled to right side of the case 1.

The first door 4 is configured to open and close a freezer compartment that consists of the storage compartment and the second door 5 is configured to open and close a refrigerator compartment that consists of the storage compartment. By nonlimiting example, the present invention may include various types of refrigerator.

In other words, the refrigerator shown in FIG. 1 is a side-by-side type having a refrigerator compartment arranged on the left and a freezer compartment arranged on the right. The refrigerator according to the present invention may be all types of refrigerators no matter how the refrigerator and freezer compartments are arranged. Also, the refrigerator may be a refrigerator only having a refrigerator or freezer compartment or a refrigerator having an auxiliary cooler compartment rather than the freezer and refrigerator compartments.

The structure of the case 1 includes an inner case 110 in which the storage space is formed, an outer case 120 accommodating the inner case 110, spaced apart a predetermined distance from the inner case, a vacuum space 130 provided between the inner case and the outer case, with being closed to maintain a vacuum state to perform the insulation function between the inner case and the outer case, and a connection pipe 200 provided in the vacuum space 130 to connect a communication hole 112 of the inner case and a communication hole 122 of the outer case with each other.

The outer case 120 is spaced apart a predetermined distance from the inner case 110. No auxiliary insulating material is provided in a space formed between the outer case 120 and the inner case 110 and the space is maintained in a vacuum state to perform insulation.

In other words, the vacuum space 130 is formed between the outer case 120 and the inner case 110, to remove a medium that delivers the heat between the cases 110 and 120.

Accordingly, the heat from the hot air outside the outer case 120 can be prevented from being transmitted to the inner case as it is.

Meanwhile, for convenience sake, FIG. 1 shows the inner case 110, the outer case 120, and spacers 150 that consist of the case, without a liquid-gas interchanger which will be described later.

The connection pipe 200 and the spacers 150 will be described later in detail.

The connection pipe 200 is used as a passage for exhausting defrosted water from an evaporator and the like or a passage for passing a pipe connected to the outside of the outer case 120 from the inside of the inner case there through. In other words, the connection pipe 200 may connect a communication hole of the inner case 110 and a communication hole of the outer case 120 with each other. Also, the connection pipe 200 may make a space defined by the inner case 110 and a space defined by the outer case 120 communicate with each other. For instance, the connection pipe 200 may be employed as a passage where the defrosted water generated in the inner case 110 is exhausted outside the outer case 120.

The connection pipe 200 may pass through the vacuum space 130. Accordingly, an external portion of the connection pipe 200, in other words, a portion corresponding to the vacuum space 130 has to be maintained vacuum. It is preferred that the connection portions of the connection pipe 200 with the inner case 110 and the outer case 120 are welded, to enable the connection pipe 200 to endure the vacuum pressure. Meanwhile, an internal space of the connection pipe 200 is separated from the vacuum space 130, in communication with the space defined by the inner case 110 the space defined by the outer case 120. Because of that, the internal space of the connection pipe 200 is not in a vacuum state.

Typically, both of the inner and outer cases 110 and 120 are fabricated of a steel sheet. Accordingly, it is preferred that the connection pipe 200 is formed of a metal material that can be welded to such a steel sheet.

In addition, the connection pipe 200 may have a lateral wall corrugated to maintain a predetermined strength for maintaining the airtightness of the vacuum space 130 and to minimize the heat transfer generated by conduction.

The corrugated lateral wall of the connection pipe 200 may be referenced to as 'a lateral wall corrugation part 240'.

The strength of such a lateral wall corrugation part 240 has to be good because such a lateral wall corrugation part 240 has to endure the vacuum pressure difference between the inside and the outside of the vacuum space 130.

To secure such a good strength, if the connection pipe simply formed of a thick steel sheet pipe is welded and connected, the strength could be sufficient but the insulation performance might be deteriorated by the heat conducted via the connection pipe.

To prevent the deterioration of the insulation performance, as shown in FIG. 3, a plurality of metal thin films having holes formed therein are layered on the lateral wall corrugation part 240 and inner diameter areas are welded to outer welded areas sequentially, such that a lateral outline may be in zigzag. The corrugated shape of the lateral wall corrugation part 240 could increase a distance according to the conduction of the inner and outer cases only to deteriorate efficiency of heat transfer generated by conduction.

Such the lateral wall corrugation part 240 may be a bellow type pipe and it is preferred that at least a predetermined portion of the connection pipe 200 according to the present invention is a bellows type pipe.

As mentioned above, the lateral wall corrugation part 240 of the connection pipe 200 is fabricated by welding inner diameter areas and outer diameter areas with each other sequentially, while layering the metal thin films. The lateral wall corrugation part 240 may be welded to an upper pipe part 220 and a lower pipe part 230 to be integrally formed with each other.

The upper pipe part 220 and the lower pipe part 230 of the connection part 200 may be circular pipes having a predetermined height, diameter and thickness, to be welded to the lateral wall corrugation part 240 to form the connection pipe 200.

The heights of the upper pipe part 220 and the lower pipe part 230 that consist of the connection pipe 200 may be determined in consideration of the heights of the lateral wall corrugation part 240 and the vacuum space 130.

For instance, when they are welded to the outer case 120 and the inner case 110, the upper pipe part 220 and the lower pipe part 230 that consist of the connection pipe 200 may be welded to be more projected upwardly and downwardly than a top surface of the outer case 120 and a bottom surface of the inner case 110 as shown in FIG. 3.

Optionally, when they are welded to the outer case 120 and the inner case 110, respectively, the heights of the upper pipe part 220 and the lower pipe part 230 composing the connection pipe 200 may be formed identical to the height of the top surface of the outer case 120 and to the height of the bottom surface of the inner case 110, respectively, not to be projected.

In addition, the height of the lateral wall corrugation part 240 of the connection pipe 200 may be identical to or smaller than the height of the vacuum space 130.

Figure 6:
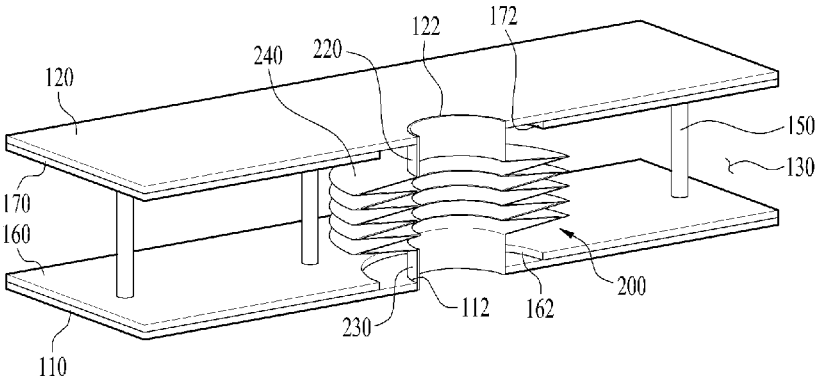
FIG. 6 is a partial sectional view illustrating a state where the connection of FIG. 4 is welded and assembled to the structure of the case of FIG. 5.

FIG. 3 shows that the height of the lateral wall corrugation part 240 is identical to the height of the vacuum space 130. However, FIG. 6 shows that the height of the lateral wall corrugation part 240 is smaller than the height of the vacuum space 130.

As the lateral wall corrugation part 240 of the connection pipe 200 is formed of the metal thin film, the strength of the metal thin film, especially, the strength for enduring the vacuum pressure in a radial direction may be enhanced remarkably. In addition, the passage where the heat is conducted via the connection pipe 200 is formed quite long, only to reduce the heat transfer generated by the conduction.

Communication holes (112 and 122, see FIG. 6) may be formed in the inner case 110 and the outer case 120, respectively.

The upper pipe part 220 of the connection pipe 200 may be welded to the communication hole 112 of the outer case 120 and the lower pipe part 230 thereof may be welded to the communication hole 122 of the inner case 110.

The lateral wall corrugation part 240 of the connection pipe 200 may be welded while layering the metal thin films. Optionally, the upper pipe part 220, the lateral wall corrugation part 240 and the lower pipe part 230 may be integrally formed with each other by a compression molding method.

The connection pipe fabricated as mentioned above is shown in FIG. 4.

The metal thin film used in forming the lateral wall corrugation part 240 of the connection pipe 200 has a thickness of 0.05-0.2 mm.

The thickness of the lateral wall corrugation part 240 has to be more than 0.05 mm to have a sufficient strength capable of enduring the vacuum pressure in the vacuum space.

The thickness of the lateral wall corrugation part 240 may have a thickness of 0.2 mm or less because it is a passage of heat transfer generated by conduction to the inner case 110 from the outer case 120.

The upper pipe part 220 and the lower pipe part 230 may be formed thicker than the lateral wall corrugation part 240. It is preferred that the upper pipe part 220 and the lower pipe part 230 are formed not so thick to reduce the conduction heat transfer only if they can maintain an appropriate strength.

The case 1 may further include a first support plate provided one of surfaces of the inner and outer cases 110 and 120 that face each other, and a plurality of spacers fixed to the first support plate to maintain a distance spaced apart between the inner case and the outer case.

The plurality of the spacers 150 may be arranged to maintain the distance between the inner case 110 and the outer case 120 to make the vacuum space 130 maintain its profile. Such the spacers 150 may support the first support plate to maintain the distance between the inner case 110 and the outer case 120.

The plurality of the spacers 150 may be fixed between the inner case 110 and the outer case 120. The plurality of the spacers 150 may be arranged in the first support plate 160 as a fixing structure.

The first support plate 160 may be provided in contact with one of facing surfaces possessed by the inner and outer cases 110 and 120.

In FIGS. 3 and 4, it is shown that the first support plate 160 is arranged to contact with an outer surface of the inner case 110. Optionally, the first support plate 160 may be arranged to contact with an inner surface of the outer case 120.

Figure 5:
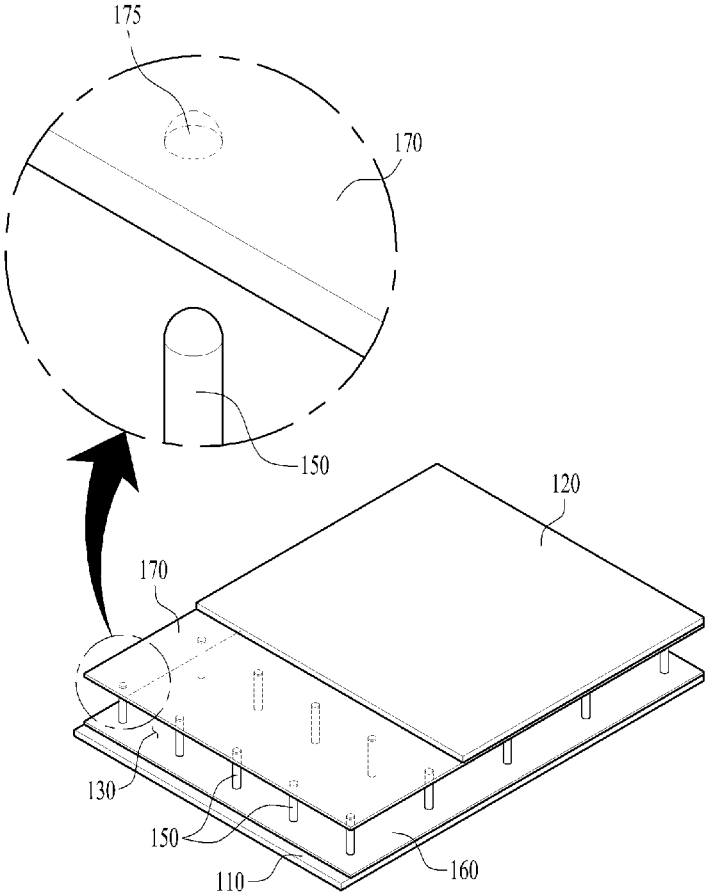
FIG. 5 is a partially cut-away perspective view illustrating an assembling structure among the inner case, the outer case and spacers.

Referring to FIGS. 5 and 6, The first support plate 160 is arranged in contact with an outer surface of the inner case 110 and a second support plate 170 arranged in contact with an inner surface of the outer case 120 may be further provided, such that ends of the spacers 150 provided in the first support plate 160 may be in contact with an inner surface of the second support plate 170.

As shown in the connection pipe 200 of FIG. 3, the lateral wall corrugation part 240 may have a larger outer diameter than a distance between neighboring two spacers adjacent to the lateral corrugation part 240.

However, as shown in FIG. 2, the connection pipe 200 may be arranged between four neighboring spacers adjacent to the connection pipe 200, without interference.

In other words, the connection pipe 200 may be arranged distant from the spacers not to interfere with the spacers 150.

Accordingly, the connection pipe 200 may be arranged between the first support plate 160 and the second support plate 170 where the spacers 150 are arranged. The heat transfer from the connection pipe 200 to the spacers 150 can be reduced as much as possible.

As shown in FIGS. 5 and 6, the case 1 may further include a second support plate 170 provided in the other one of facing surfaces possessed by the first and second cases 110 and 120, with facing the first support plate.

In the embodiment shown in FIGS. 5 and 6, the second support plate 170 is arranged to contact with the inner surface of the outer case 120 and the spacers 150 are fixedly arranged in the first support plate 160 to maintain a distance spaced apart between the first support plate 160 and the second support plate 170.

The first support plate 160 is in contact with the outer surface of the inner case 110 and the second support plate 170 is in contact with the inner surface of the outer case 120. Accordingly, the spacers 150 supportably maintain the distance between the inner case 110 and the outer case 120.

In the embodiment shown in FIGS. 5 and 6, the second support plate 170 is provided spaced apart a predetermined distance from the first support plate 160. Optionally, as shown in FIG. 2, only the first support plate 160 where the plurality of the spacers 150 are integrally formed may be provided between the inner case 110 and the outer case 120.

In case of no second support plate 170 as mentioned above, ends of the spacers 150 may be arranged to directly contact with the inner surface of the outer case 120.

FIG. 5 shows no connection pipe 200 for convenience sake.

As shown in a circle enlarged in FIG. 5, the second support plate 170 may include a plurality of grooves 175 formed in an inner surface thereof to insert ends of the spacers 150 therein, respectively.

The plurality of the grooves 175 formed in the second support plate 170 may facilitate the fixing of relative position with respect to the spacers 150, when the second support plate 170 is placed on the spacers 150 integrally formed with the first support plate 160.

An end of each spacer 150 may be convexly curved.

As shown in a circle enlarged in FIG. 5, ends of the spacers 150 are convexly curved. In the assembly process, the end of each spacer 150 is easily seated in each groove 175 formed in the second support plate 170, only to ease the assembling work.

Moreover, it is more preferred that the plurality of the grooves 175 formed in the second support plate 170 are convexly curved, corresponding to the shape of the spacers 150.

The shapes of the grooves 175 formed in the second support plate 170 may be corresponding to the shapes of the spacers 150. Accordingly, it is easy to determine the positions of the spacers in the assembling work and the second support plate 170 can be fixed in parallel with the ends of the spacers, without movement.

The connection pipe 200 may be welded to the inner case 110 and the outer case 120, after passing through the first support plate 160 and the second support plate 170.

In FIG. 6, the communication holes 112 and 122 are formed in the inner case 110 and the outer case 120, respectively, to enable the upper and lower parts of the connection pipe 200 welded to the inner case 110 and the outer case 120, respectively.

In other words, outer surfaces of the upper pipe part 220 and the lower pipe part 230 composing the connection pipe 200 are welded to the communication hole 112 of the inner case and the communication hole 122 of the outer case 120, respectively.

Moreover, communication holes 162 and 172 may be formed in the first support plate 160 and the second support plate 170, respectively. The communication holes 162 and 172 may be concentric with respect to the connection pipe 200.

The diameters of the communication holes 162 and 172 formed in the first and second support plates 160 and 170, respectively, may be larger than the diameters of the communication holes 112 and 122 formed in the inner case 110 and the outer case 120.

The inner case 110 and the outer case 120 may be formed of a steel sheet. The first support plate 160 and the second support plate 170 may be formed of metal, ceramic or reinforced plastic.

When the connection pipe 200 is welded to the inner case 110 and the outer case 120, the first support plate 160 and the second support plate 170 as the structures for supporting the spacers 150 might be affected. It is preferred that the communication holes 162 and 172 of the first and second support plates 160 and 170 may be larger than the communication holes 112 and 122 of the inner and outer cases 110 and 120.

Lastly, it is preferred that an inner surface of the connection pipe 200 is coated by plastic to prevent corrosion.

Liquid such as water or refrigerant may flow or external air may be drawn in the connection pipe 200 formed of the metal thin film. An inner surface of the connection pipe 200 might be corroded.

Figure 7:
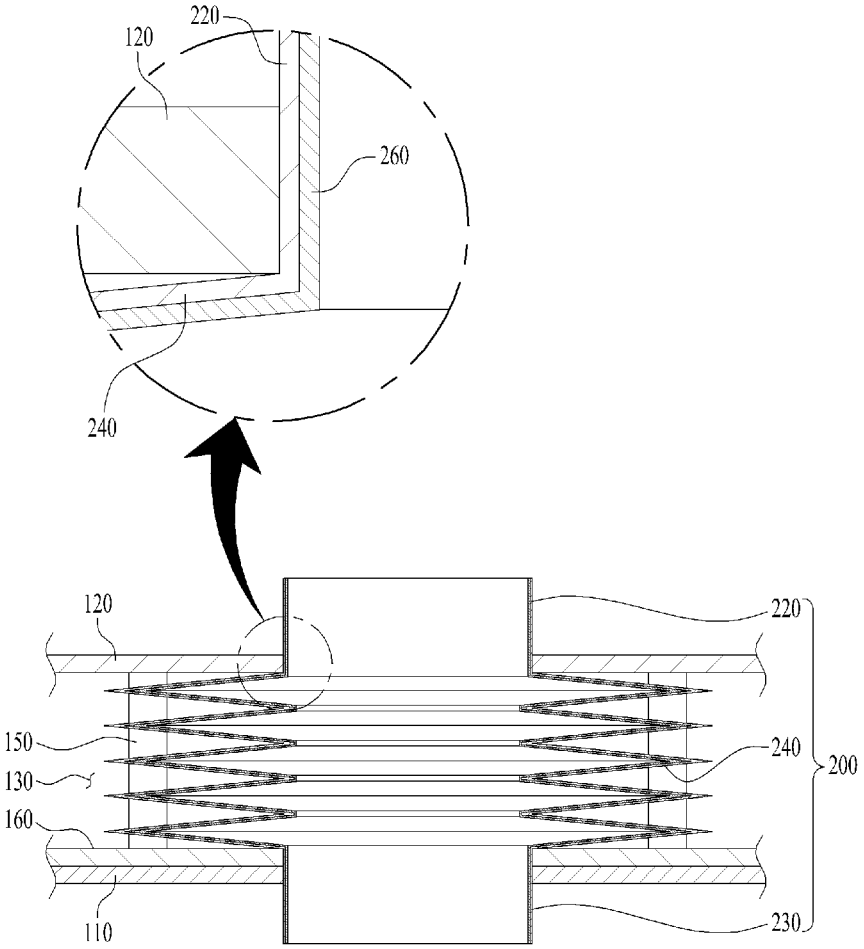
FIG. 7 is a sectional view illustrating a plastic coated layer formed in an inner surface of the connection pipe.

Accordingly, as shown in FIG. 7, a plastic coated layer 260 is formed on the inner surface of the connection pipe 200 and corrosion may be prevented. Accordingly, durability of the connection pipe 200 may be enhanced.

According to the refrigerator having the vacuum space, the connection pipe can endure the vacuum pressure while drained water or pipe is flowing in the connection pipe.

Moreover, the lateral wall of the connection pipe is formed of a bellow pipe and the connection pipe can reduce the heat transfer as much as possible.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an inner case comprising a first communication hole;

an outer case spaced apart from the inner case, the outer case comprising a second communication hole;

a vacuum space between the inner case and the outer case;

a connection pipe configured to couple the first communication hole to the second communication hole, the connection pipe comprising an external portion positioned in the vacuum space between the inner case and the outer case and an internal portion separated from the vacuum space, wherein a conduction path through the connection pipe between the inner case and the outer case is longer than a width of the vacuum space to decrease conduction efficiency between the inner case and the outer case, or wherein an outer diameter of the connection pipe is greater than a diameter of any one of the first communication hole and the second communication hole to decrease conduction efficiency by increasing a heat transfer passage of conduction between the inner case and the outer case, or wherein an inner diameter of the connection pipe is smaller than a diameter of any one of the first communication hole and the second communication hole to decrease conduction efficiency by increasing a heat transfer passage of conduction between the inner case and the outer case.

2. The refrigerator according to claim 1, further comprising a first spacer and a second spacer disposed adjacent to the first spacer, the outer diameter of the connection pipe being greater than the distance between the first spacer and the second spacer.

3. A refrigerator comprising:

an inner case comprising a first communication hole;

an outer case spaced apart from the inner case, the outer case comprising a second communication hole;

a vacuum space between the inner case and the outer case;

a connection pipe connecting the first communication hole to the second communication hole, the connection pipe passing through the vacuum space, an external portion of the connection pipe corresponding to the vacuum space and an internal portion of the connection pipe being separated from the vacuum space; and a supporting structure to provide a separation between the inner case and the outer case, the supporting structure being disposed around the connection pipe, wherein the connection pipe is spaced apart a distance from the supporting structure such that the connection pipe does not interfere with the supporting structure.

4. The refrigerator according to claim 3, wherein the supporting structure comprising a spacer configured to maintain the vacuum space between the inner case and the outer case.

5. The refrigerator according to claim 4, wherein the connection pipe is spaced apart a distance from the spacer such that the connection pipe does not interfere with spacer.

6. The refrigerator according to claim 4, further comprising a support plate connecting at least two spacers.

7. The refrigerator according to claim 4, further comprising a support plate where the spacer is fixed.

8. The refrigerator according to claim 7, wherein an end of the spacer is to be received in a corresponding groove formed in the support plate.

9. The refrigerator according to claim 3, wherein the supporting structure comprising a support plate configured to be arranged to contact with at least one of an outer surface of the inner case and an inner surface of the outer case, the support plate comprising a third communication hole.

10. The refrigerator according to claim 9, wherein the diameter of the third communication hole is larger than the diameters of the first and the second communication holes such that the connection pipe does not interfere with the support plate.

11. A refrigerator comprising:

an inner case comprising a first communication hole;

an outer case spaced apart from the inner case, the outer case comprising a second communication hole;

a vacuum space between the inner case and the outer case; and a connection pipe configured to couple the first communication hole to the second communication hole, the connection pipe comprising an external portion positioned in the vacuum space between the inner case and the outer case and an internal portion separated from the vacuum space, wherein the connection pipe comprises a thin metal to reduce heat transfer between the inner case and the outer case via a lateral wall that is configured to endure a vacuum pressure difference between an inside of the vacuum space and an outside of the vacuum space, and wherein the connection pipe comprises a portion having a thickness smaller than a thickness of at least one of the inner case and the outer case to decrease conduction efficiency between the inner case and the outer case.

12. The refrigerator according to claim 11, wherein the thickness of the lateral wall is more than 0.05 mm to have a sufficient strength capable of enduring the vacuum pressure in the vacuum space.

13. The refrigerator according to claim 11, wherein the connection pipe comprises a corrugation part so that a strength of the connection pipe for enduring the vacuum pressure in a radial direction is enhanced.

14. The refrigerator according to claim 11, wherein an anti-corrosion coating layer is provided on the inner surface of the connection pipe to reduce corrosion.

15. The refrigerator according to claim 14, wherein the anti-corrosion coating layer includes a plastic.

16. The refrigerator according to claim 11, further wherein the vacuum space contacts the outer surface of the connection pipe directly without another insulator.

17. The refrigerator according to claim 11, wherein the connection pipe connects the first communication hole and the second communication hole, wherein the first communication hole is formed in the inner case and the second communication hole is formed in the outer case.

18. The refrigerator according to claim 11, wherein the connection pipe couples a space provided by the first communication hole to a space provided by the second communication hole, wherein the connection pipe is disposed in the first communication hole and the second communication hole.

19. The refrigerator according to claim 11, wherein the connection pipe comprises a lateral wall disposed between the inner case and the outer case, the lateral wall includes an inner diameter area and an outer diameter area.

20. The refrigerator according to claim 11, wherein an inner diameter area is sealed to an outer diameter area sequentially, such that an outline of the lateral wall may be in zigzag.

21. The refrigerator according to claim 11, wherein the connection pipe comprises a lateral wall disposed between the inner case and the outer case, and wherein an upper pipe part, the lateral wall, and a lower pipe part are connected to each other.

22. The refrigerator according to claim 21, the upper pipe part extends above a top surface of the outer case or is flush with the top surface of the outer case.

23. The refrigerator according to claim 21, the lower pipe part extends below a bottom surface of the inner case or is flush with the bottom surface of the inner case.

24. The refrigerator according to claim 21, the lower pipe part is coupled to the first communication hole.

25. The refrigerator according to claim 21, the upper pipe part is coupled to the second communication hole.

26. The refrigerator according to claim 21, wherein the upper pipe part and the lower pipe part are connected with the lateral wall after the lateral wall is formed.

27. The refrigerator according to claim 21, wherein the upper pipe part, the lateral wall and the lower pipe part are integrally formed with each other by a compression molding method.

28. The refrigerator according to claim 21, wherein the upper pipe part configured to be sealed to the outer case.

29. The refrigerator according to claim 21, wherein the lower pipe part configured to be sealed to the inner case.

* * * * *